US007722041B2

(12) United States Patent
Honda

(10) Patent No.: US 7,722,041 B2
(45) Date of Patent: May 25, 2010

(54) SHEET PROCESSING APPARATUS AND IMAGE FORMING APPARATUS

(75) Inventor: Kazuhiro Honda, Kashiwa (JP)

(73) Assignee: Canon Finetech Inc., Misato-shi (JP)

( * ) Notice: Subject to any disclaimer, the term of this patent is extended or adjusted under 35 U.S.C. 154(b) by 691 days.

(21) Appl. No.: 11/534,292

(22) Filed: Sep. 22, 2006

(65) Prior Publication Data

US 2007/0069448 A1 Mar. 29, 2007

(30) Foreign Application Priority Data

Sep. 26, 2005 (JP) ..... 2005-278866

(51) Int. Cl.
*B65H 39/10* (2006.01)

(52) U.S. Cl. ..... 271/288; 271/292; 271/294; 271/298; 271/176; 270/58.19

(58) Field of Classification Search ..... 271/288, 271/292, 294, 298, 176; 270/58.19, 58.14; 399/405, 83

See application file for complete search history.

(56) References Cited

U.S. PATENT DOCUMENTS 7,349,645 B2 * 3/2008 Ohnishi et al. ..... 399/82
2004/0207152 A1 * 10/2004 Watanabe et al. ..... 271/294

FOREIGN PATENT DOCUMENTS

JP 2573690 3/1998
JP 10-198101 7/1998

* cited by examiner

*Primary Examiner*—Patrick H Mackey
*Assistant Examiner*—Luis Gonzalez
(74) *Attorney, Agent, or Firm*—Fitzpatrick, Cella, Harper & Scinto

(57) ABSTRACT

Provided is a sheet processing apparatus, including: a stacking unit that is capable of stacking discharged sheets; a drive mechanism that is capable of moving the stacking unit; a storage device that holds data on a moving time of the stacking unit in a rewritable manner; an arithmetic unit that is calculates an estimated value of the moving time of the stacking unit based on the data; and a correcting unit that corrects the data held in the storage device by using an actual measurement value of the moving time of the stacking unit.

8 Claims, 11 Drawing Sheets

FIG. 9

| | ASCENDING [mm/s] | DESCENDING [mm/s] |
|---|---|---|
| 0–99 SHEETS | 60 | 70 |
| 100–199 SHEETS | 58 | 71 |
| . . . | . . . | . . . |
| 900–999 SHEETS | 40 | 80 |

FIG. 12A

SPEED OF TRAY 1

| | ASCENDING [mm/s] | DESCENDING [mm/s] |
|---|---|---|
| 0–99 SHEETS | 60 | 70 |
| 100–199 SHEETS | 58 | 71 |
| . . . | . . . | . . . |
| 900–999 SHEETS | 40 | 80 |

FIG. 12B

SPEED OF TRAY 2

| | ASCENDING [mm/s] | DESCENDING [mm/s] |
|---|---|---|
| 0–99 SHEETS | 50 | 70 |
| 100–199 SHEETS | 45 | 72 |
| . . . | . . . | . . . |
| 900–999 SHEETS | 30 | 84 |

SHEET PROCESSING APPARATUS AND IMAGE FORMING APPARATUS

BACKGROUND OF THE INVENTION

1. Field of the Invention

The present invention relates to a sheet processing apparatus for receiving sheets, which are discharged from an image forming apparatus such as a copying machine, a printer, a facsimile, and a composite machine, or discharged from other business machines, and stacking the sheets on ascendable/descendable sheet stacking means.

2. Description of the Related Art

A sheet processing apparatus for receiving sheets discharged from an image forming apparatus such as a copying machine, a printer, and a facsimile to perform processes such as alignment, sorting, stacking, stapling, bookbinding, punching, and checking has been put into practical use. In addition, in some types of image forming apparatuses, such the sheet processing apparatus is built therein or connected thereto as a so-called purchase option.

Some types of sheet processing apparatuses are provided with an ascendable/descendable stacking tray, and are capable of continuously stacking a large amount of sheets by allowing the stacking tray to descend in accordance with a stacking process of sheets or sheet bundles.

A sheet processing apparatus disclosed JP H10-198101 A is provided with an ascendable/descendable stacking tray having a plurality of stages, and is capable of stacking sheets after positioning a designated stage of the stacking tray having the plurality of stages at a sheet receiving position. In addition, an arithmetic control device of the sheet processing apparatus estimates a total estimated time for sheet processing prior to performing the sheet processing, and notifies an image forming apparatus of a sheet discharge interval (i.e., time) calculated on a predetermined safety time or a safety factor in addition to the total estimated time. Further, the arithmetic control device of the image forming apparatus allows sheets to undergo image formation at the sheet discharge intervals and allows the image forming apparatus to discharge the sheets.

The total estimated time in the sheet processing apparatus is constituted of individual estimated times for respective operations from sheet reception to completion of height adjustment of a stacking tray on which sheets are already stacked, such as a sheet transporting time, a staple process time, and a stacking tray-moving time. In many cases, a length of each of the individual estimated times is 1 second or shorter. Meanwhile, the individual estimated time for an operation of switching a stacking tray of a discharge destination is incomparably long, that is, from 10 seconds to 30 seconds. Accordingly, when the operation of switching the stacking tray is frequently performed, a waiting time for processing of the image forming apparatus increases, thereby remarkably lowering a process speed. As a result, both the sheet processing apparatus and the image forming apparatus cannot utilize potential processing abilities of those.

SUMMARY OF THE INVENTION

As described above, a time required for a switching operation of a stacking tray constitutes a greater portion of a total time required for an entirety of sheet processing. As a result, if the switching time of the stacking tray can be shortened, it is possible to increase the number of sheets to be processed per minute to a large extent by shortening a sheet discharge interval time. However, when a high output and high speed are realized in a motor so as to increase an ascending/descending speed of the stacking tray, a power consumption is increased, and it becomes difficult to reduce the sheet processing apparatus in size and weight. In addition, manufacturing costs of parts are also increased. Further, a mechanical strength of a supporting mechanism and a drive mechanism must be increased, and a mechanical damage or a damage of a sheet caused in case of a possible accident becomes serious.

A sheet processing apparatus disclosed in JP 10-198101 A adds a predetermined safety time to a time which is preset in accordance with a moving distance, a moving direction, and a stacking amount of a stacking tray, thereby calculating an estimated time for a switching operation of sheet stacking means. Meanwhile, the safety time is set to expect an individual difference or temporal change of the motor or mechanism. When an excessive time is set by considering a worst case, an estimated process time for sheet processing becomes unnecessarily long, which lowers the process speed of the image forming apparatus.

In other words, the moving time of the stacking tray greatly varies depending on the individual difference, the temporal change, a difference of a drive voltage, or the like of a motor or a mechanism. However, when an excessive safety time or safety factor is expected so as to allow such the uncertainties, the estimated process time for the sheet processing is excessively increased in many cases. On the other hand, when the safety time or safety factor is expected to be small, in a case where an actual moving time is increased in rare cases due to the temporal change such as deterioration, abrasion, a rust of a permanent magnet provided to the motor, a sheet discharge interval of the image forming apparatus becomes excessively small. As a result, the sheet processing apparatus is more likely to cause paper jamming, which increase a possibility of causing a damage of a sheet or a mechanical trouble.

According to a first aspect of the present invention, there is provided a sheet processing apparatus, including: a stacking unit that is capable of stacking discharged sheets; a drive mechanism that is capable of moving the stacking unit; a storage device that holds data on a moving time of the stacking unit in a rewritable manner; an arithmetic unit that calculates an estimated value of the moving time of the stacking unit based on the data; and a correcting unit that corrects the data held in the storage device by using an actual measurement value of the moving time of the stacking unit.

According to the present invention, the sheet processing apparatus sets a small safety time or safety factor while absorbing an individual difference, a temporal change, or the like of a motor or a mechanism for driving a sheet stacking unit, thereby making it possible to shorten an estimated time for a switching operation. As a result, it is possible to perform the sheet processing at high speed by fully utilizing the potential processing ability of the sheet processing apparatus without changing the motor or the mechanism.

Further features of the present invention will become apparent from the following description of exemplary embodiments with reference to the attached drawings.

BRIEF DESCRIPTION OF THE DRAWINGS

FIG. 9 is an explanatory diagram of a data structure of tray moving speeds.

FIGS. 12A and 12B are explanatory diagrams of data structures of tray moving speeds.

DESCRIPTION OF THE EMBODIMENTS

A description is given as to a sheet processing apparatus 1 according to an embodiment of the present invention, and a copying machine E according to one mode of an image forming apparatus provided with the sheet processing apparatus 1 with reference to the attached drawings. Note that the sheet processing apparatus of the present invention is not limited to a staple process according to this embodiment, but may have a structure in which sheets are merely stacked on sheet stacking means, may be additionally provided with a structure for performing another process such as a punching process, or may be carried out with a structure for performing only the other processes or with another structure for performing the same processes. In addition, the image forming apparatus of the present invention is not limited to the copying machine E according to this embodiment, but may be carried out in a facsimile, a printer, various printing machines, or the like.

In addition, the sheet processing apparatus 1 according to this embodiment may be connected to a printing apparatus or the like other than an apparatus main body 100 of the copying machine E. The sheet processing apparatus 1 according to this embodiment may be constituted of another housing which can be separated from the apparatus main body 100, or may be incorporated into a housing of the apparatus main body 100 in an inseparable manner.

<Image Forming Apparatus>

Figure 1:
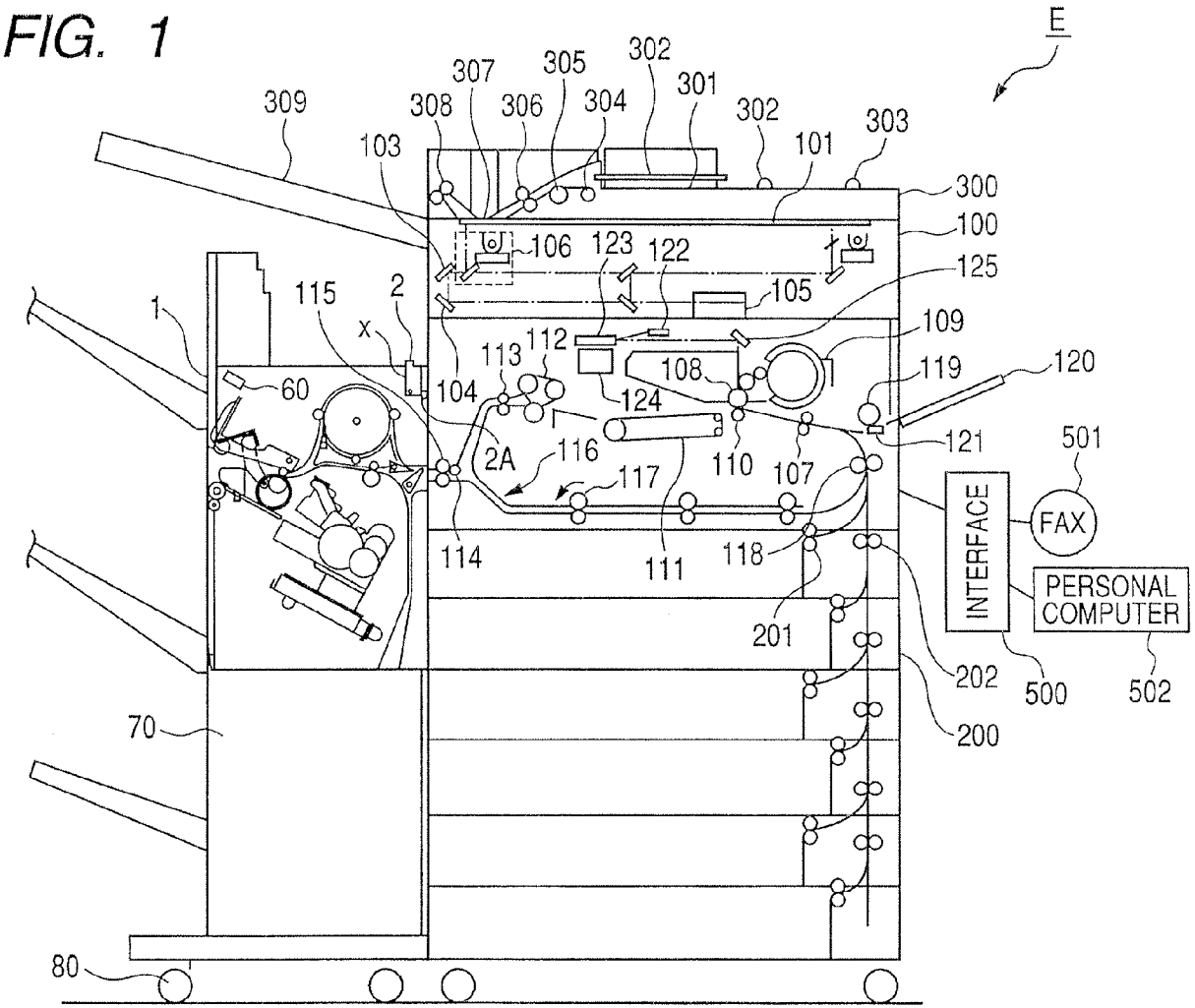
FIG. 1 is an explanatory view of an internal structure of a copying machine which is an example of an image forming apparatus provided with a sheet processing apparatus according to an embodiment of the present invention.

FIG. 1 shows an internal structure of a copying machine which is an example of an image forming apparatus provided with a sheet processing apparatus according to this embodiment. The copying machine E is provided with an apparatus main body 100 serving as image forming means, and a sheet processing apparatus, for example, a sheet processing apparatus 1.

As shown in FIG. 1, the sheet processing apparatus 1 is arranged beside the apparatus main body 100 of the copying machine E. In the sheet processing apparatus 1, discharged sheets on which images are formed in the apparatus main body 100 are received, and the sheets can be stacked on a ascendable/descendable tray unit 26 (see FIG. 2). At an upper portion of the apparatus main body 100, there is arranged an automatic document feed (hereinafter, referred to as "ADF") 300 for automatically feeding documents. At a lower portion of the apparatus main body 100, there are arranged feed cassettes 200 loaded with plural kinds of sheets with different sizes.

In the automatic document feed 300, take-out rollers 304 and 305 take out one by one a plurality of read documents 302 stacked on each other on a feed tray 301. Transport rollers 306 and 308 transport the sheets to pass through a read position 307, and discharge and stack the sheets onto a discharge tray 309. An image formed on a lower surface of the read document 302 is read through a scanning unit 106 which is allowed to stop immediately below the read position 307.

The scanning unit 106 is mounted with an illuminating device (not shown) having a long length in a depth direction and a mirror (not shown) integrated with each other, and is movable from left to right in FIG. 1. In a case where the automatic document feed 300 is opened to a rear side to place documents one by one on a glass plate of the apparatus main body 100, the scanning unit 106 is moved from left to right in FIG. 1, thereby reading the image.

In any case, the image formed on a surface of the document illuminated by the illuminating device of the scanning unit 106 is relayed by mirrors 103 and 104 from the mirror of the scanning unit 106, and is cast on a light receiving element (not shown) of a reading part 105 by an optical system (not shown). A linear image is read from the cast image by the light receiving element. An image signal of the read linear image is amplified in a signal processing circuit (not shown), is subjected to digital processing or the like, and is converted into image data to be temporarily stored.

The apparatus main body 100 transfers a toner image formed on a photosensitive drum 108 onto a sheet taken out from one of the feed cassettes 200, thereby performing image formation. A light source 122 is controlled by the image signal produced from the image data, and outputs a light beam corresponding to the image signal. A scanning part 124 produces a scanning beam by rotating a scanning mirror 123 in synchronization with an output of the light source 122. The scanning beam is applied onto the photosensitive drum 108 which is uniformly charged, thereby forming an electrostatic latent image on a surface of the photosensitive drum 108.

The electrostatic latent image formed on the surface of the photosensitive drum 108 is developed by allowing toner supplied from a developing unit 109 to adhere thereto, thereby obtaining a toner image.

On the other hand, a sheet on which an image is to be formed is taken out of a corresponding feed cassette 200 in advance by take-out rollers 201, transport rollers 118 and 202, and the like. Then, the sheet is allowed to abut against a registration roller pair 107 which are stopped to stand by.

The registration roller pair 107 is driven in synchronization with the rotation of the photosensitive drum 108, and performs registration such that a leading end of the toner image is aligned with a leading edge of the sheet transported between the photosensitive drum 108 and a transferring part 110. The transferring part 110 charges the sheet and transfers the toner image on the surface of the photosensitive drum 108 to the sheet. The sheet having the toner image transferred thereon is transported to a fixing part 112 by a transport belt 111, and then the toner image is fixed on the surface of the sheet by being heated and pressurized in the fixing part 112.

In a case of a one-side printing, the sheet having the toner image fixed thereon passes through transporting rollers 113 and a flapper 114 to be discharged from a discharge roller pair 115 directly to the sheet processing apparatus 1. Meanwhile, in a case of a two-side printing, the flapper 114 is switched while a trailing edge of the sheet is nipped by the discharge roller pair 115, thereby switching back the sheet to a reverse path 116. Then, transport rollers 117 and 118 transport the sheet, and the sheet is allowed to abut against the registration roller pair 107 to stand by while rear and front surfaces of the sheet are reversed. In a similar manner as in the one-side printing, the sheet which is on standby is transported between the photosensitive drum 108 on which the toner image is formed, and the transferring part 110, thereby transferring the toner image also onto a rear surface of the sheet. The fixing part 112 fixes the toner image on the sheet, and the sheet is discharged to the sheet processing apparatus 1.

The apparatus main body 100 activates the photosensitive drum 108 at an interval of a sheet processing time which is notified from the sheet processing apparatus 1, and controls respective parts, such as the light source 122, of the apparatus main body 100 to perform image formation and sheet discharge. The sheet processing apparatus 1 reads out settings of process contents transmitted from the apparatus main body 100, calculates the sheet processing time required for the process for each sheet, and transmits the calculated sheet processing time to the apparatus main body 100.

<Sheet Processing Apparatus>

Figure 2:
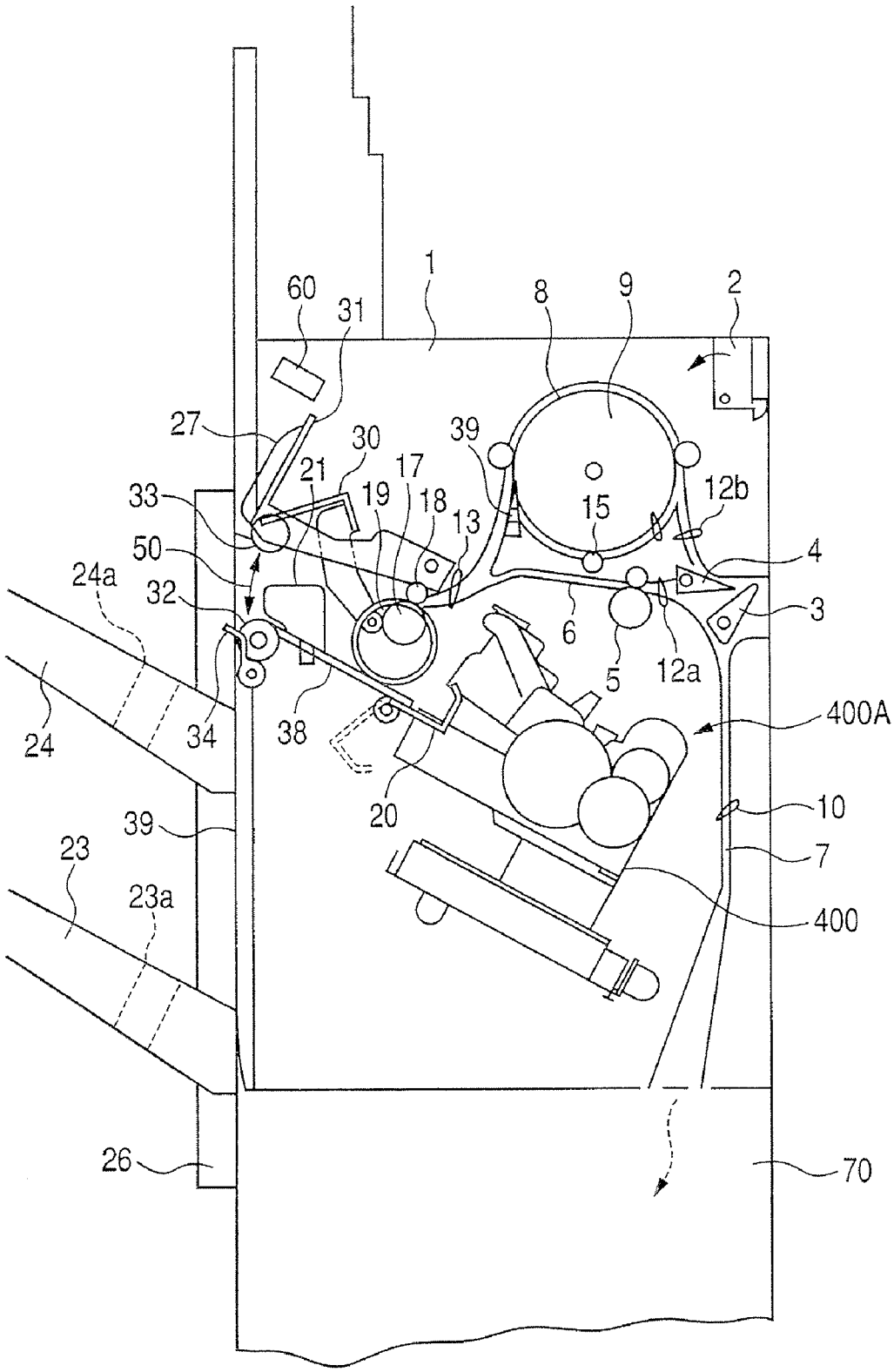
FIG. 2 is a partially enlarged view of the sheet processing apparatus according to the embodiment.

FIG. 2 is a partially enlarged view of the sheet processing apparatus according to this embodiment. The sheet processing apparatus 1 includes: sheet stacking means, for example, the tray unit 26; arithmetic means, for example, a CPU 600; storage means, for example, a flash memory 51; correcting means, for example, the CPU 600; load detecting means, for example, the CPU 600; direction control means, for example, the CPU 600; distance detecting means, for example, a shift clock sensor 49; time detecting means, for example, the CPU 600; image forming means, for example, the apparatus main body 100; control means, for example, a control part 150; and an image forming apparatus, for example, the copying machine E.

Sheets discharged from the discharge roller pair 115 of the apparatus main body 100 are subjected to the set process in the sheet processing apparatus 1 as shown in FIG. 2, and then discharged onto a designated first tray 23 (or second tray 24) of the tray unit 26 to be stacked thereon.

A flapper 3 switches a sheet transport path between a third transport path 7 for guiding sheets into a folding device 70 arranged at a lower portion of the sheet processing apparatus 1, and a first transport path 6 for guiding sheets into a staple tray 38. A flapper 4 switches a sheet transport path between a second transport path 8 provided with a buffer roller 9, and the first transport path 6. When the sheets are stacked on the staple tray 38, an upstream side end portion of the flapper 3 is positioned downward, and an upstream side end portion of the flapper 4 is positioned upward. As a result, the sheets are transported into the first transport path 6 through a roller pair 5. When the sheets are transported into the folding device 70, the upstream side end portion of the flapper 3 is positioned upward. In order to transport the sheets to the buffer roller 9 for buffering, the upstream side end portion of the flapper 4 is positioned downward.

The staple tray 38 temporarily stacks the sheets before being stacked on the tray unit 26 to perform various processes. The sheets discharged onto the staple tray 38 by a first discharge roller 17 and a holding-down roller 18 are transported in a lower right direction by a discharge alignment belt 19, and then trailing edges of the sheets are allowed to abut against a bumping plate 20.

The discharge alignment belt 19 rotates by being nipped between the first discharge roller 17 and the holding-down roller 18, and is provided with an endless rib (not shown) in the vicinity of a central part of an inner side of the belt as a prevention against deviation of the belt. The bumping plate 20 is movable from a home position at which the bumping plate 20 subsequently aligns the trailing edges of the sheets, to an evacuating position (indicated by the broken line) at which the bumping plate 20 does not interrupt movement of a stapler unit 400. Side edges of the sheets abutted against the bumping plate 20 are aligned by moving a lateral shifting guide 21 to the inner side while the discharge alignment belt 19 is deformed upward to cancel the abutment.

With respect to the sheet bundle obtained on the staple tray 38 by being repeatedly subjected to the stacking and aligning operations, it is possible to perform a staple process in the trailing edge portion thereof by activating the stapler unit 400. The sheet bundle subjected to the staple process is nipped between a moving discharge roller 33 and a discharge roller 32 by rotating a rotating guide 31 provided on an outlet side, and is transported in a left direction of FIG. 2 to be discharged onto the first tray 23 (or the second tray 24) of the tray unit 26.

The rotating guide 31 holds the moving discharge roller 33 in a rotatable manner. When the sheets are stacked on the staple tray 38, the rotating guide 31 causes the moving discharge roller 33 to rotate upward to be spaced apart from the discharge roller 32. Meanwhile, in a case where the sheets are not stacked on the staple tray 38, in other words, in a case where the sheets are discharged to the tray unit 26 one by one without forming a sheet bundle, the rotating guide 31 is caused to rotate downward, thereby bringing the moving discharge roller 33 into press-contact with the discharge roller 32. Thus, the sheets are discharged from a nip between the first discharge roller 17 and the holding-down roller 18 to a nip between the moving discharge roller 33 and the discharge roller 32.

The buffer roller 9 performs buffering by nipping the sheets between peripheral parts such as a buffer roller 15 and the buffer roller 9. When the stapler unit 400 is activated to perform stapling, an upper end side of a flapper 39 is rotated leftward, and two, three, and more sheets are overlapped on each other to be wound around the buffer roller 9. As a result, it is possible to continuously receive sheets from the apparatus main body 100 (see FIG. 1) even during the movement and activation of stapler unit 400. The sheets held, i.e., buffered, on the buffer roller 9 are rotated around the buffer roller 9 once while the upper end side of the flapper 39 is rotated rightward. Thus, the sheets are discharged to the nip between the first discharge roller 17 and the holding-down roller 18, thereby being stacked on the staple tray 38 as a sheet bundle.

The stapler unit 400 includes a stapler for performing a stapling operation with respect to the sheet bundle stacked on the staple tray 38, and is capable of performing one-position stitch on a front side, two-position stitch, and one-position stitch on a trailing side.

A sheet detecting sensor 10 detects a leading edge and a trailing edge of the sheet entering the third transport path 7. A sheet detecting sensor 12*a* detects the leading edge and the trailing edge of the sheet entering the first transport path 6. A sheet detecting sensor 13 detects the trailing edge of the sheet discharged to the nip between the moving discharge roller 33 and the discharge roller 32. A sheet detecting sensor 12*b* detects the sheet entering a second transport path 8, and the detection result is utilized for a rotational control of the buffer roller 9.

The tray unit 26 is an ascendable/descendable stack table unit which is mounted with the lower first tray 23 and the upper second tray 24 fixed thereto. The tray unit 26 is driven by a shift motor 601 (see FIG. 3) having a drive mechanism (not shown) built in the housing of the sheet processing apparatus 1. A rack gear provided to the tray unit 26 is engaged with an ascendable/descendable gear of the drive mechanism to be rotated, thereby moving the tray unit 26 in a vertical direction.

A distance sensor 60 arranged at the upper portion of the housing of the sheet processing apparatus 1 includes an infrared light emitting element and light receiving sensor, and detects a reflected right from an object in front of the distance sensor 60 to generate an output according to the distance. The distance sensor 60 detects a distance from the distance sensor 60 to an uppermost surface of the sheets (or a sheet bundle) stacked on the first tray 23 (or the second tray 24).

<Control of Sheet Processing Apparatus>

Figure 3:
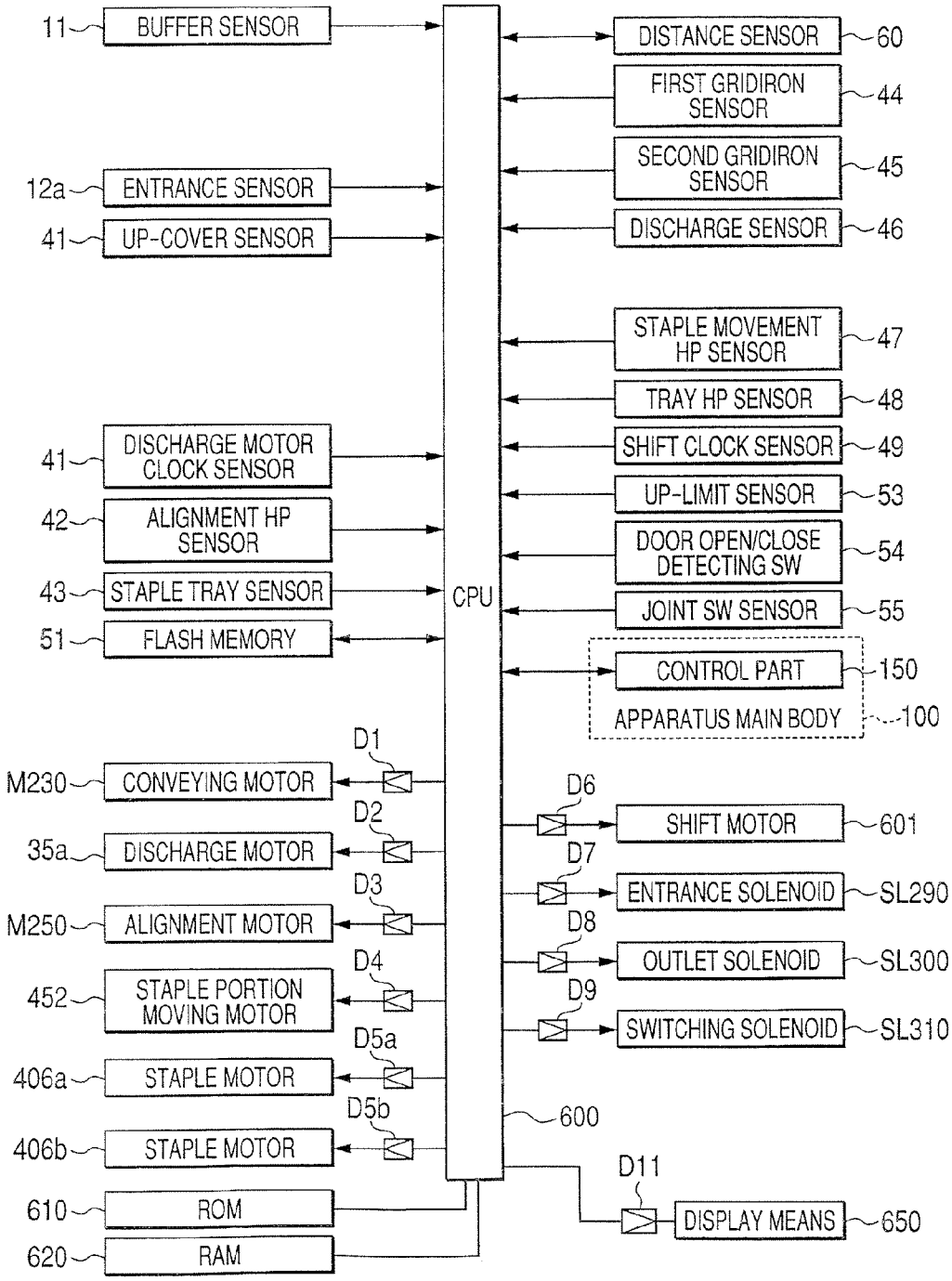
FIG. 3 is a block diagram of a control system of the sheet processing apparatus.

The sheet processing apparatus 1 is controlled by the CPU 600 serving as a microcomputer system as shown in FIG. 3. The CPU 600 has a ROM, a RAM, a serial interface circuit, and the like (not shown) built therein. A processing program corresponding to a control procedure of the flowcharts shown in FIGS. 4 to 8 is stored in the ROM. The processing program read out from the ROM is held in the RAM, and working data, input data, communication data, calculation results, and the like which are subsequently generated in control processes are written/deleted every control process. The serial interface circuit performs transmitting/receiving the control data to/from the control part 150 of the apparatus main body 100 (see FIG. 1), and is also capable of communicating bi-directionally with other computers and a facsimile reception part (not shown).

The flash memory 51 connected to the CPU 600 holds data on moving speeds shown in FIG. 9 in a nonvolatile and rewritable manner. The data on the moving speeds held in the flash memory 51 is initially set to have a sufficient margin. In addition, when the parts of the tray unit 26 are replaced, the data on the moving speed is reset to the initial setting.

After that, the actual measurement values of the moving speeds are calculated every ascending/descending of the tray unit 26 by using the measured ascending/descending distance and ascending/descending time, and the data on the moving speeds is corrected every ascending/descending of the tray unit 26 based on the actual measurement values. As a result, the data on the moving speeds is replaced with numerical values having less allowance and corresponding to the actual measurement values. Time required for replacement of stack trays which is calculated based on the corrected data on the moving speeds becomes a shortened time while securing sufficient safety factors.

An input side of the CPU 600 is electrically connected not only to the distance sensor 60, but also to a buffer sensor 11, an entrance sensor 12*a*, an up-cover sensor 40, a discharge motor clock sensor 41, a staple tray sensor 43, a first gridiron sensor 44, a second gridiron sensor 45, a discharge sensor 46, a staple movement HP sensor 47, a shift clock sensor 49, an up-limit sensor 53, a door open/close detecting SW 54, a joint SW sensor 55, and other sensors, respectively.

The buffer sensor 11 detects that the sheet is on standby at the buffer roller 9. The entrance sensor 12*a* detects the sheet discharged from the apparatus main body 100 enters the sheet processing apparatus 1. The up-cover sensor 40 detects that an upper cover of the sheet processing apparatus 1 is opened. The discharge motor clock sensor 41 outputs each pulse of a predetermined rotational angle of a discharge motor 35*a* to provide information on a malfunction caused when the sheet is discharged from the inside of the sheet processing unit 1 to the tray unit 26, or information on a speed control.

An alignment HP sensor 42 detects a home position of the bumping plate when stapling is performed. The staple tray sensor 43 detects presence or absence of the sheet on the staple tray 38. The first gridiron sensor 44 and the second gridiron sensor 45 detect positions of an upper gridiron guide 27 and a lower gridiron guide 30 (see FIG. 2) which form upper and lower wall surfaces of an outlet 50, respectively. The discharge sensor 46 detects that the sheet is discharged from the inside of the sheet processing unit 1 onto the first tray 23 (or the second tray 24).

The staple movement HP sensor 47 detects that the stapler unit 400 capable of moving inside the sheet processing apparatus 1 is positioned at the home position. The shift clock sensor 49 detects a movement of the ascendable/descendable tray unit 26, or a malfunction or the like caused in the shift motor 601 serving as the drive source of the tray unit 26 to notify such the information of the CPU 600. The up-limit sensor 53 detects an upper limit of the movable tray unit 26. The door open/close detecting SW 54 detects opening/closing of a door of the sheet processing apparatus 1. The joint SW sensor 55 detects that the sheet processing apparatus 1 is connected to the apparatus main body 100.

On the other hand, an output side of the CPU 600 is electrically connected not only with the shift motor 601, but also a transport motor M230, a discharge motor 35*a*, an alignment motor M250, a staple portion moving motor (i.e., pulse motor) 452, a staple motor 406*a*, a staple motor 406*b*, an entrance solenoid SL290, an outlet solenoid SL300, a switching solenoid SL310, display means 650, and other motors and actuators, through drivers D1, D2, D3, D4, D5*a*, D5*b*, D7, D8, D9, and D11, respectively.

The transport motor M230 drives the roller pair 5 and the first discharge roller 18 to transport the sheet provided within the sheet processing apparatus 1. The discharge motor 35*a* drives the discharge roller 32 to discharge the sheet (or sheet bundle) to the tray unit 26. The alignment motor M250 drives the width shifting guide 21 to align the sheets. The staple portion moving motor 452 moves the stapler unit 400. The staple motor 406*a* causes the staple portion for stapling the sheet bundle to perform a stapling operation.

The staple motor 406*b* causes the staple portion for stapling the sheet bundle to perform the stapling operation. The entrance solenoid SL290 drives the flapper 3 to switch a transport path for the sheets discharged from the copying apparatus main body 100. The outlet solenoid SL300 drives the flapper 4 to switch an outlet for the sheets discharged from the inside of the sheet processing apparatus 1. The switching solenoid L310 drives the flapper 39 to switch the transport path for the sheets within the sheet processing apparatus 1. The display means 650 draws an attention of an operator when over-stacking or the like of the sheets is detected in measurement of a sheet stacking surface distance.

The CPU 600 reads out the processing program from the ROM, and causes the PAM to hold the read processing program. According to the processing program, the CPU 600 refers to outputs of those sensors to perform a necessary calculation process based on the control data sent from the control part 150 of the apparatus main body 100. Further, the CPU 600 controls the various motors, solenoids, and the like, thereby performing control for each part of the sheet processing apparatus 1.

The CPU 600 detects an output of the distance sensor 60, and measures a distance from the distance sensor 60 to the uppermost surface of the sheets (or sheet bundle) stacked on the first tray 23 (or the second tray 24). Further, the CPU 600 causes the tray unit 26 to descend every time a predetermined number of sheets are stacked on the first tray 23 (or the second tray 24), or every time a sheet bundle is stacked thereon, and causes the tray unit 26 to stop at a position where the same distance as that obtained before the sheets are stacked is measured. As a result, the first tray 23 (or the second tray 24) is caused to descend by a thickness of the stacked sheets (or sheet bundle), thereby maintaining the height of the uppermost surface (i.e., stacking surface) of the stacked sheets to be substantially constant.

The CPU 600 corrects the data on the moving speed Which is stored in the flash memory 51 every time the tray unit 26 is caused to ascend or descend for replacement of trays. Then, the CPU 600 gradually decreases a margin of the moving time as an estimated time, shortens a sheet processing time (i.e., an estimated time required for replacement of trays) which is to be transmitted to the control part 150 of the apparatus main body 100, and shortens a sheet discharge interval of the apparatus main body 100. As a result, the process speed of the sheet processing apparatus 1 is gradually increased.

<Calculation of Sheet Processing Time>

In the apparatus main body 100 shown in FIG. 1, image formation is started and a signal for a stacking probe (i.e., pre-registration-on request) is transmitted from the control part 150 to the CPU 600 shown in FIG. 3 at a timing when sheets are taken out from one of the feed cassettes 200.

Figure 4:
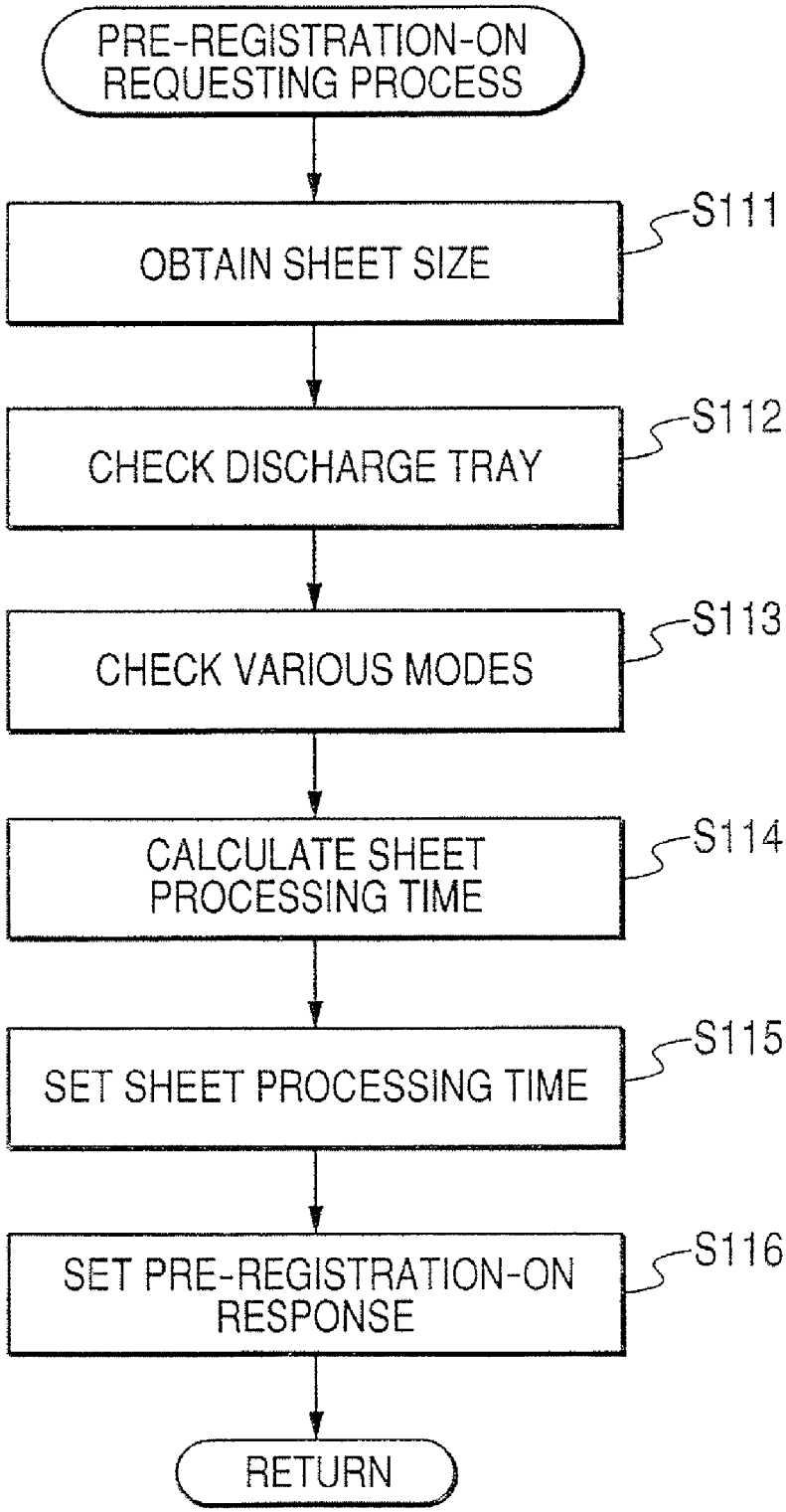
FIG. 4 is a flowchart of a control for calculation of a sheet discharge interval to be transmitted.

Then, as shown in FIG. 4, the CPU 600 extracts settings for the process contents from the communication data transmitted from the control part 150 to store the extracted settings in the RAM provided inside the CPU 600. The CPU 600 acquires a sheet size (S111), checks which of the first tray 23 or the second tray 24 a sheet is to be discharged onto (S112), checks that a process mode is set at simple stacking, a staple process, or the like (S113), and calculates the sheet processing time (i.e., estimated time) for the sheet on which an image is to be formed, based on the contents of the settings (S114). Then, the calculated sheet processing time is set in a RAM for transmission (S115) and the calculated sheet processing time is sent back to the control part 150 together with a response signal (S116). As a result, the control part 150 waits only for the sheet processing time designated by the CPU 600 to start the subsequent image formation and sheet discharge process.

Figure 5:
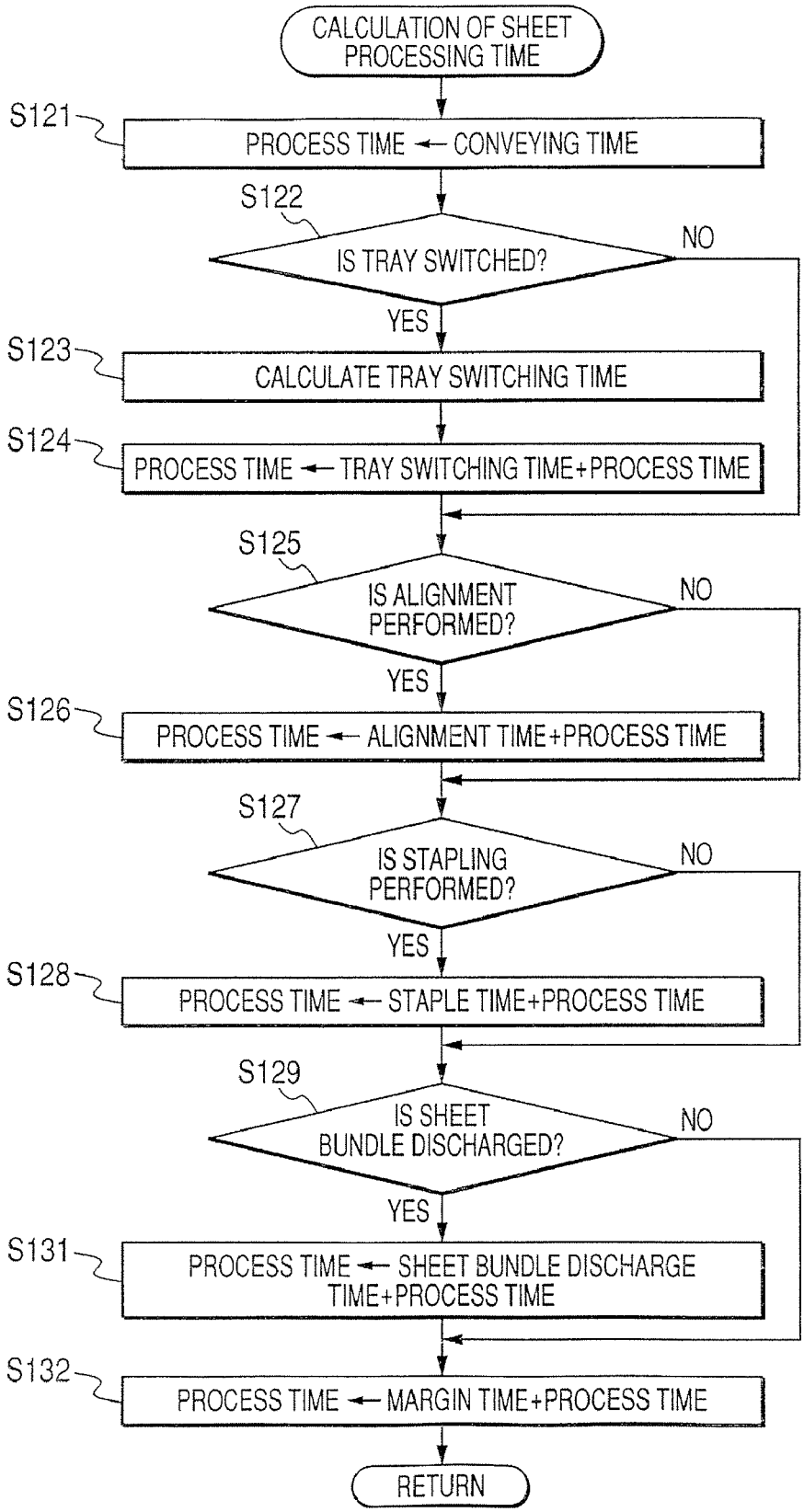
FIG. 5 is a flowchart of calculation of a sheet processing time.

In Step S114, a sheet processing time calculation process shown in FIG. 5 is invoked. As shown in FIG. 5, a transport time is first set as a process time required for sheets to pass through the sheet transport path (S121). After that, the CPU 600 checks whether or not it is necessary to perform switching from the first tray 23 to the second tray 24, or the second tray 24 to the first tray 23 (S122). In a case where the switching is to be performed (Yes in Step S122), the CPU 600 calculates the process time by performing the tray switching time calculation process shown in FIG. 6 (S123), and adds the acquired process time to the process time set in Step S121 (S124). In a case where the switching is not to be performed (No in Step S122), the acquired process time is not added thereto.

After that, the CPU 600 checks whether or not alignment is to be performed (S125). In a case where the alignment is to be performed, a predetermined alignment time is added to the process time (S126). Then, the CPU 600 checks whether or not a staple process is to be performed (S127), and in a case where the staple process is to be performed, a predetermined staple time is added to the process time (S128). After that, the CPU 600 checks whether or not a discharge of a sheet bundle is to be performed (S129). In a case where the discharge of the sheet bundle is to be performed, a predetermined sheet bundle discharge time is added to the process time (S131).

Finally, the CPU 600 takes into account an error as a sheet processing time, and adds a predetermined margin time without conditions (S132) to determine the sheet processing time. The control part 150 of the apparatus main body 100 determines a discharge timing of a transfer sheet based on the determined sheet processing time, thereby controlling the time interval between the discharge of a preceding sheet and that of a subsequent sheet.

Figure 6:
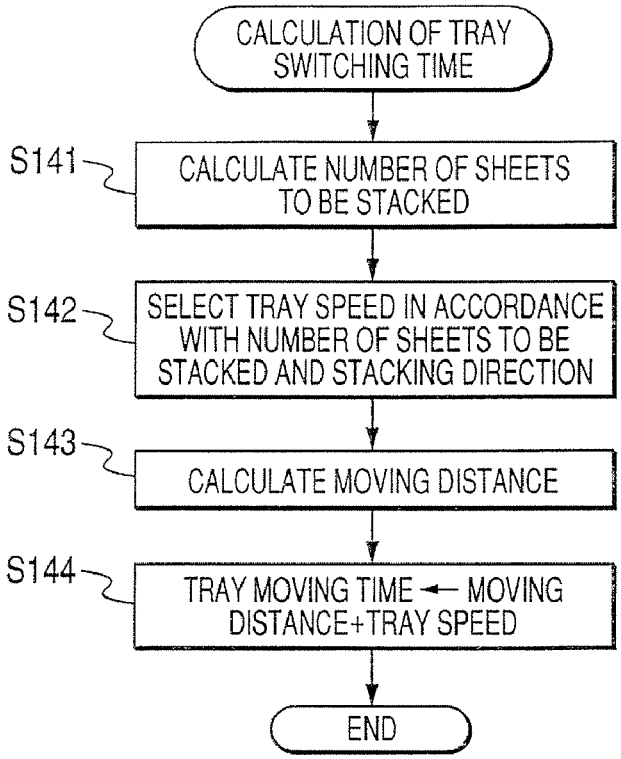
FIG. 6 is a flowchart of calculation of a tray switching time.

As shown in FIG. 6, in the tray switching time calculation process of Step S123, the CPU 600 first adds the number of stacked sheets on the first tray 23 to the number of stacked sheets on the second tray 24, thereby calculating a total number of stacked sheets in the tray unit 26 (S141). Then, the CPU 600 selects a value of a tray speed in accordance with a moving direction (i.e., ascending or descending) of the tray unit 26 and the number of stacked sheets in the tray unit 26, from a table containing tray speeds shown in FIG. 9 which is recorded in a rewritable nonvolatile memory (S142). Next, the CPU 600 calculates the moving distance from a current position of the tray unit 26 to a position after switching of the trays of the tray unit 26 (S143), thereby obtaining the estimated time for movement of the tray based on the moving distance and the tray speed (S144).

Figure 7:
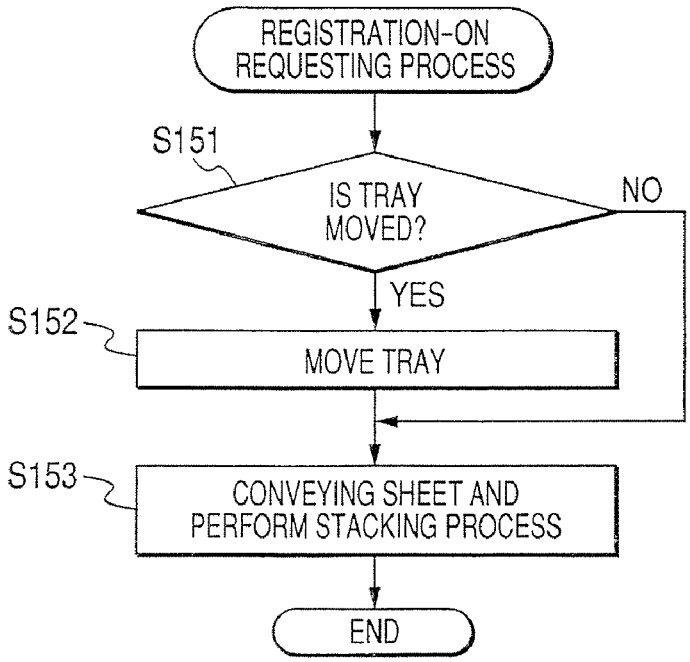
FIG. 7 is a flowchart of a sheet stacking control.

When the sheet processing time is transmitted to the control part 150 in Step S116 shown in FIG. 4, a process starting signal (i.e., registration-on request) is transmitted from the control part 150 to the CPU 600, and then the CPU 600 starts a stacking process shown in FIG. 7. As shown in FIG. 7, prior to arrival of the sheet, the CPU 600 first checks whether or not movement of the tray is to be performed (S151). In a case where the movement of the tray is necessary, the tray unit 26 is caused to move (S152). Determination as to whether or not the movement of the tray is necessary is executed by comparing a tray which is currently provided at the outlet with the discharge tray checked in the above-mentioned pre-registration-on requesting process shown in FIG. 5.

The CPU 600 waits for the arrival of the sheet discharged from the apparatus main body 100, and then executes various processes, sheet transportation, a sheet stacking process, or the like in the sheet processing apparatus 1 (S153).

Figure 8:
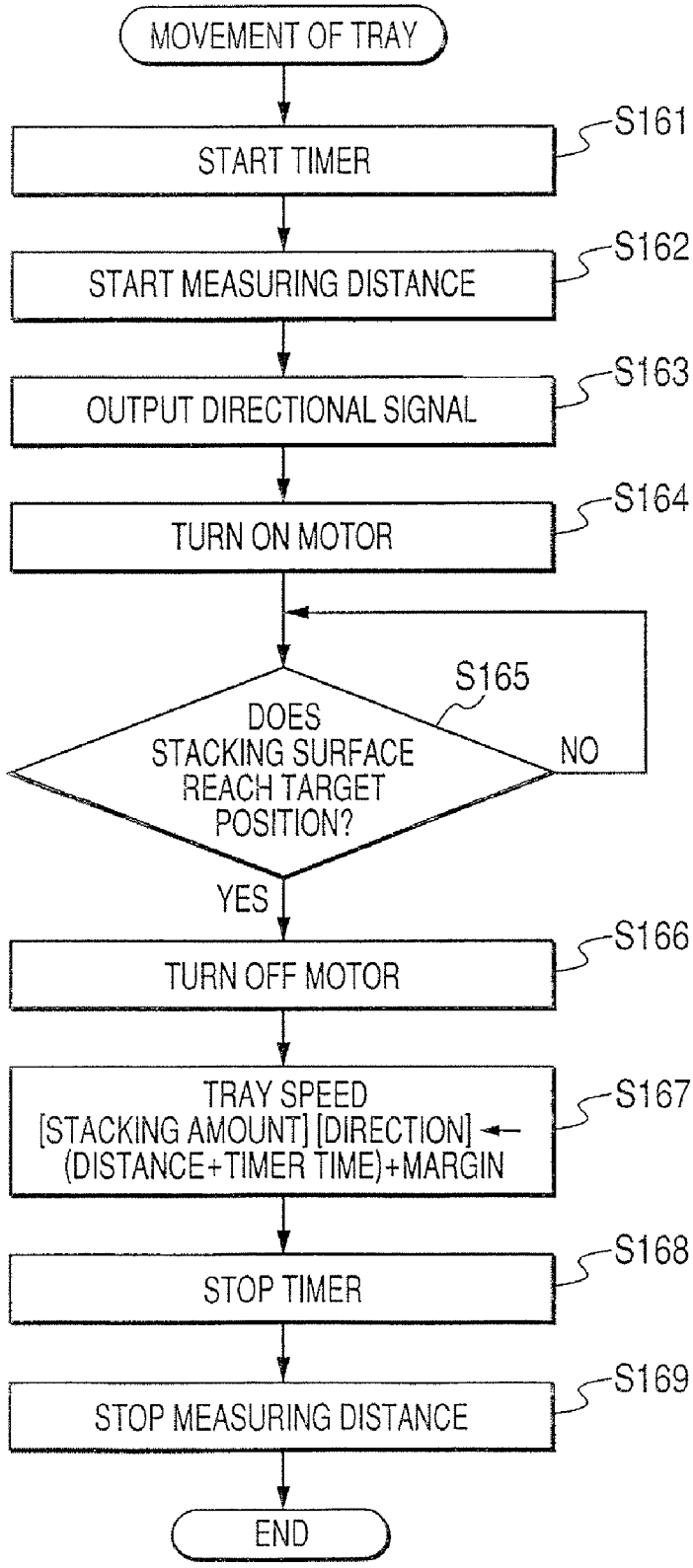
FIG. 8 is a flowchart of a control for calculating a tray moving speed.

In a case where the movement of the tray is performed in Step S152, a learning process of the tray speed shown in FIG. 8 is carried out. As shown in FIG. 8, the CPU 600 first starts time counting, that is, counting of clock pulses (S161), and starts measuring the moving distance, that is, counting output pulses of the shift clock sensor 49 (S162). Then, the CPU 600 outputs a moving direction signal (S163) and initiates the shift motor 601. As a result, the tray unit 26 starts moving.

Then, the CPU 600 refers to the output of the distance sensor 60, and determines whether or not the stacking surface of the designated first tray 23 (or second tray 24) has reached a predetermined stacking height (S165). When the first tray 23 (or second tray 24) reaches a target position in accordance with the movement of the tray unit 26 (YES in Step S165), the CPU 600 turns off a motor driving signal of the shift motor 601 (S166).

Then, the CPU 600 divides the moving distance (which is converted from pulse-count) which is obtained when the first tray 23 (or second tray 24) reaches the target position by a time count value obtain at the time, thereby calculating the actual measurement value of the moving speed in ascending or descending of the tray unit 26 at the time. The CPU 600 adds a predetermined safety time (i.e., margin) to the calculated value, and corrects the data on the moving speed which is recorded in the flash memory 51 (S167). In other words, the data on a corresponding range of the number of stacked sheets and on the moving direction among the data on the moving speeds shown in FIG. 9 is replaced with a value obtained by adding the margin to the actual measurement value at the time.

It should be noted that instead of simply replacing the data with the value, it is possible to execute calculation of the moving average in which the preceding data is replaced with a value obtained by averaging the pieces of data of the past several times of measurements in the same classification. Alternatively, instead of calculating the moving speed, it is possible to record the actual measurement value of the moving time in the flash memory 51 to perform control of correcting the data for every ascend or descend of the tray unit 26.

Also, it is possible to perform the control by storing another process time as constants on the apparatus main body 100 side, performing calculation in which only an estimated time for replacement of trays is selected from the flash memory 51, and transmitting only the selected data from the sheet processing apparatus 1 to the apparatus main body 100. Further, in the table shown in FIG. 9, it is possible to periodically correct the data in a frame, in which frequency of writing data is small, by interpolation calculation or extrapolation calculation by using data with high frequency of being written. When data greatly different from the preceding data is calculated by the calculation of the actual measurement or actual measurement values, the replacement of the data may be cancelled.

After that, the CPU 600 stops a timer (S168) and the measuring of the distance (S169) as an end process, thereby completing this process.

As shown in FIG. 9, the flash memory 51 holds a speed learning table in a nonvolatile manner. The speed learning table is defined as a two-dimensional arrangement of the number of stacked sheets and the moving direction, and the number of stacked sheets is learned individually per 100 sheets. This table learns by storing the moving speeds during the process of the flowchart shown in FIG. 8, and refers to a learning value to be used for calculation of the moving time of the tray in the process of the flowchart shown in FIG. 6.

In the sheet processing apparatus according this embodiment, the actual measurement value of the moving time (i.e., switching time) of the tray is calculated in accordance with the distance and time each detected during the movement of the tray. Based on the thus obtained actual measurement value, it is possible to obtain an optimized time, which is more approximate to the actual operating time, by the subsequent calculation of the sheet processing time. As a result, the productivity of the sheet processing apparatus having a plurality of stack trays, and that of the image forming system can be enhanced.

Another Embodiment

Figure 10:
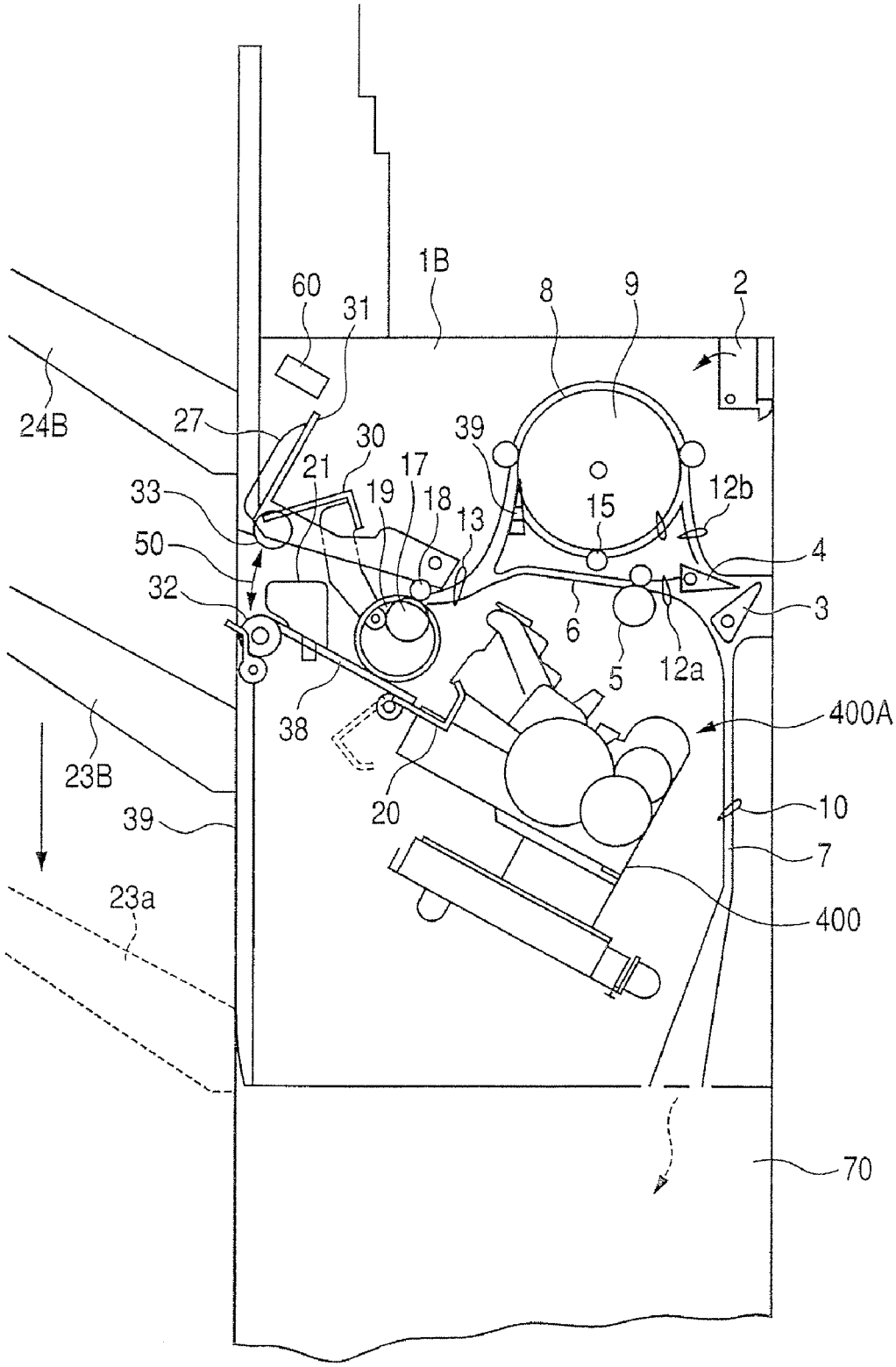
FIG. 10 is a partially enlarged view of a sheet processing apparatus according to another embodiment of the present invention.
Figure 11:
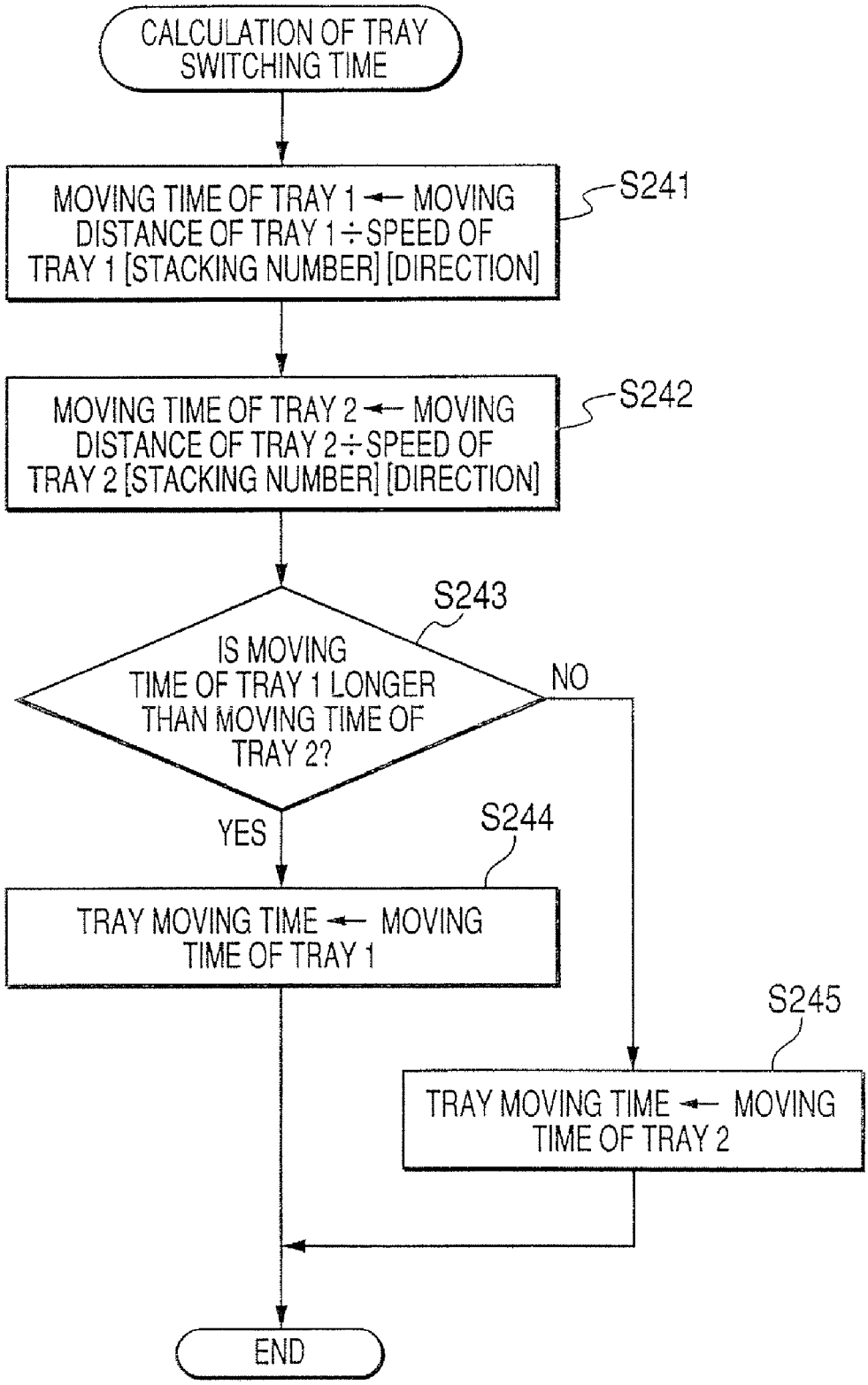
FIG. 11 is a flowchart of calculation of a tray switching time.

Another embodiment will be described with reference to FIGS. 10 to 12. FIG. 10 is a partially enlarged view of a sheet processing apparatus according to another embodiment of the present invention. FIG. 11 is a flowchart of a calculation of a tray switching time. FIGS. 12A and 12B are explanatory diagrams of a data structure of the tray moving speeds. A sheet processing apparatus 1B according to another embodiment is provided with a first tray 23B and a second tray 24B, both of which are independently provided in an ascendable/descendable manner, the first tray 23B being provided below the second tray 24B. The first tray 23B and the second tray 24B are provided in place of the tray unit 26 of the sheet processing apparatus 1 according to the embodiment described with reference to FIGS. 1 to 9, in which an interval between two trays is fixed. Structures of the sheet processing apparatus 1B other than the above-mentioned difference are similar to those of the sheet processing apparatus 1. Accordingly, the same reference symbols are given to the same parts, and detailed descriptions thereof will be omitted.

The CPU 600 measures an ascending/descending time and ascending/descending distance for each of the first tray 23B and the second tray 24B, and corrects two process time tables as shown in FIGS. 12A and 12B for each of the actual ascending/descending movements, thereby having the tables held in a nonvolatile memory. When calculating a sheet processing time to be transmitted to the control part 150 of the apparatus main body 100, the CPU 600 calculates the tray switching time by the process of the flowchart shown in FIG. 11.

As shown in FIG. 10, in the sheet processing apparatus 1B, the first tray 23B and the second tray 24B are independently supported in an ascendable/descendable manner. The first tray 23B and the second tray 24B each have a shift motor (not shown) and a drive mechanism built therein, and a rack provided to the sheet processing apparatus 1B is engaged with pinion gears of the respective driving mechanisms. As a result, the first tray 23B and the second tray 24B are independently driven to ascend or descend.

Accordingly, in the sheet processing apparatus 1B, when a discharge destination is changed from the first tray 23B to the second tray 24B, the first tray 23B is caused to descend to a position indicated by the broken line to stand by, while the second tray 24B is caused to descend to a height position at which a lower stacking surface of a sheet outlet 50 reaches a predetermined height. Meanwhile, when the discharge destination is changed from the second tray 24B to the first tray 23B, the second tray 24B is caused to ascend to the above of the sheet outlet 50 to stand by, while the first tray 23B is caused to ascend until reaching right below the sheet outlet 50 from the standby position indicated by the broken line.

When calculating the sheet processing time to be transmitted to the control part 150 of the apparatus main body 100 prior to the sheet processing (Step S114 of FIG. 4), in a case where switching between the first tray 23B and the second tray 24B is necessary for the designated process (YES in Step S122 of FIG. 5), the CPU 600 calculates a time required for switching between the first tray 23B and the second tray 24B (S123).

When calculating the time for switching between the first tray 23B and the second tray 24B, the CPU 600 first calculates a moving time of the first tray 23B as shown in FIG. 11 (S241). In other words, the moving distance of the first tray 23B is calculated based on a current height position of the first tray 23B and a height position thereof after the first tray 23B is moved. In addition, based on the current number of stacked sheets on the first tray 23B and the moving direction of the first tray 23B, the moving speed is selected from the table shown in FIG. 12A. Then, the calculated moving distance is divided by the selected moving speed, thereby calculating the moving time of the first tray 23B.

Next, the moving time of the second tray 24B is calculated (S242). In other words, the moving distance of the second tray 24B is calculated based on a current height position of the second tray 24B and a height position thereof after the second tray 24B is moved. In addition, based on the current number of stacked sheets on the second tray 24B and the moving direction of the second tray 24B, the moving speed is selected from the table shown in FIG. 12B. Then, the calculated moving distance is divided by the selected moving speed, thereby calculating the moving time of the second tray 24B.

Next, the moving time of the first tray 23B is compared with that of the second tray 24B (S243), and when the moving time of the first tray 23B is longer than that of the second tray 24B (YES in Step S243), the moving time of the first tray 23B is selected (S244). On the other hand, when the moving time of the second tray 24B is longer than that of the first tray 23B (NO in Step S243), the moving time of the second tray 24B is selected (S245).

The table of FIG. 12A showing moving times of the first tray 23B is replaced with latest moving speeds calculated by the actual measurement of the moving distance and moving time every time the first tray 23B is moved by the actual switching of the tray, in accordance with the process of the flowchart shown in FIG. 8.

The table of FIG. 12B showing moving times of the second tray 24B is also replaced with latest moving speeds calculated by the actual measurement of the moving distance and moving time every time the second tray 24B is moved by the actual switching of the tray, in accordance with the process of the flowchart shown in FIG. 8.

In the sheet processing apparatus 1B, the CPU 600 acquires the speed of the first tray 23B by referring to the table in terms of the number of stacked sheets and moving direction of the first tray 23B, multiplies an inverse of the acquired speed by the moving distance, and substitutes the calculation result into the moving time of the first tray 23B which is a work variable. In a similar manner, the CPU 600 acquires the speed of the second tray 24B by referring to the table in terms of the number of stacked sheets and moving direction of the second tray 24B, multiplies an inverse of the acquired speed by the moving distance, and substitutes the calculation result into the moving time of the second tray 24B which is a work variable. Then, the CPU 600 determines a magnitude correlation between both of the work variables acquired herein, selects a time longer than the other, and substitutes the longer time into a variable tray moving time. As a result, an optimal value of the tray moving time is obtained based on the data in the same condition as learned before, and a moving time of the first tray or the second tray which is longer than the other is selected, thereby making it possible to obtain a safe tray switching time.

The object of the present invention is also achieved by providing a storage medium, which stores a program of software for realizing the functions according to the embodiments, to a system or an apparatus, and reading out program codes stored in the storage medium to execute the program. In this case, the program codes and the storage medium in which the program codes are stored constitute the present invention.

It should be noted that the present invention is not limited to the above-mentioned embodiments, and may be carried out by being appropriately modified without departing from the spirit of the present invention. For example, the image forming apparatus is not limited to that employing the electrophotographic process, and various types of apparatuses capable of printing images, such as those employing an ink jet system, a thermal system, and the like may be adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-278866, filed Sep. 26, 2005, which is hereby incorporated by reference herein in its entirety.

What is claimed is:

1. A sheet processing apparatus, comprising:

a stacking unit that is capable of stacking sheets discharged from a discharge unit;

a drive mechanism that is capable of moving the stacking unit;

a storage device that holds data on a moving speed of the stacking unit in a rewritable manner; and a computer unit that calculates an estimated value of a moving time of the stacking unit based on a distance by which the stacking unit is to be moved and the data on the moving speed, and corrects the data on the moving speed held in the storage device by using actual measurement values of a moving distance and a moving time of the stacking unit, wherein the computer unit notifies the discharge unit of a time interval based on the estimated value on the moving time.

2. A sheet processing apparatus according to claim 1, wherein the computer unit calculates an estimated value of a process time for an entirety of sheet processing including the moving time.

3. A sheet processing apparatus according to claim 1, wherein the data on the moving speed further contains information on a moving speed corresponding to a sheet stacking load of the stacking unit.

4. A sheet processing apparatus according to claim 1, wherein the data on the moving speed further contains information on a moving direction of the stacking unit.

5. A sheet processing apparatus according to claim 1, wherein the computer unit corrects the data on the moving speed based on an average of a plurality of the moving speeds calculated by using the actual measurement values of the moving distance and the moving time.

6. A sheet processing apparatus according to claim 1, further comprising a plurality of stacking units, wherein the computer unit calculates an estimated time for each of the stacking units to select a stacking unit having a shortest estimated time, and the drive mechanism moves the selected stacking unit.

7. A sheet processing method, comprising the steps of:

holding data on a moving speed of a stacking unit capable of stacking sheets in a storage device in a rewritable manner;

calculating an estimated value of a moving time of the stacking unit based on a distance by which the stacking unit is to be moved and the data on the moving speed;

moving the stacking unit and measuring actual measurement values of a moving distance and a moving time of the stacking unit;

discharging sheets to the stacking unit;

correcting the data on the moving speed held in the storage device by using the actual measurement values of the moving distance and the moving time of the stacking unit; and controlling a time interval of a sheet discharge based on the estimated value of the moving time.

8. A sheet processing apparatus, comprising:

an image forming device that forms an image on a sheet;

a sheet processing device that processes the sheet on which an image is formed;

a stacking unit that is capable of stacking sheets discharged from the sheet processing device;

a drive mechanism that is capable of moving the stacking unit;

a storage device that holds data on a moving speed of the stacking unit in a rewritable manner;

a computer unit that calculates an estimated value of a moving time of the stacking unit based on a distance by which the stacking unit is to be moved and the data on the moving speed, and corrects the data held in the storage device by using actual measurement values of a moving distance and a moving time of the stacking unit; and a control unit that controls a time interval of a sheet discharge from the image forming device to the sheet processing device based on the estimated value of the moving time.

* * * * *